US005762336A

United States Patent [19]

Miller, Jr.

[11] Patent Number: 5,762,336

[45] Date of Patent: Jun. 9, 1998

[54] THREE DIMENSIONAL INTERLOCKING PUZZLE

[76] Inventor: Joseph Lee Miller, Jr., 100 Sandler Dr., Lafayette, Colo. 80026

[21] Appl. No.: 876,258

[22] Filed: Jun. 16, 1997

[51] Int. Cl.[6] ..... A63F 9/12

[52] U.S. Cl. ..... 273/160; 273/156

[58] Field of Search ..... 273/160, 156, 273/153 R

[56] References Cited

U.S. PATENT DOCUMENTS

| | | | |
|---|---|---|---|
| 1,050,141 | 1/1913 | Joy | 273/156 |
| 1,880,130 | 9/1932 | Goldbach | 273/156 |
| 2,446,120 | 7/1948 | Wiswesser | 273/156 |
| 2,783,046 | 2/1957 | Lien | 273/160 |
| 2,961,779 | 11/1960 | Perry | 434/280 |
| 3,577,660 | 5/1971 | Kenney | 434/280 |
| 3,790,175 | 2/1974 | Ragnow | 273/160 |
| 4,082,356 | 4/1978 | Johnson | 273/160 |
| 4,335,165 | 6/1982 | Powers | 273/160 |
| 5,344,148 | 9/1994 | Asch | 273/156 |
| 5,465,961 | 11/1995 | Burtch . | |
| 5,553,856 | 9/1996 | Barnard | 273/156 |

FOREIGN PATENT DOCUMENTS 1 169 821 3/1959 Germany .

*Primary Examiner*—Steven B. Wong

*Attorney, Agent, or Firm*—Donald W. Margolis; Emery L. Tracy

[57] ABSTRACT

A three-dimensional take-apart and put-together puzzle is provided. The device comprises a plurality of discs with each disc having spaced first and second planar side surfaces. A male element projects from each first planar side surface. A female element extends through the disc defining a receptacle for receiving the male element of a different disc. A radial slot is formed in each disc with each radial slot alignable with the radial slot of a corresponding disc upon positioning the first planar surfaces of a pair of discs against one another forming an overlapping, unconnected disc set whereby the aligned radial slots of a disc set mateably connect with the aligned radial slots of a corresponding disc set creating interlocking disc groups. Each interlocking disc group releasably connects with at least one other interlocking disc group through mating of the male elements with the female elements.

18 Claims, 5 Drawing Sheets

THREE DIMENSIONAL INTERLOCKING PUZZLE

BACKGROUND OF THE INVENTION a.) Field of the Invention

This invention relates generally to puzzles and, more particularly, it relates to three-dimensional take-apart and put-together puzzles having individual puzzle pieces which are interlockable with one another.

b.) Description of the Prior Art

Throughout time immemorial, there have been attempts to create and market interlocking three-dimensional puzzles or models. The main game or entertainment value of puzzles is in achieving the more or less tricky task of creating an order out of disorder. The disassembling or mixing-up does not appear to have any special appeal for the puzzle consumer. Therefore, for many puzzles, the interest in the puzzle will wane as soon as it is determined how it can be assembled correctly and can be solved. Therefore there is always a need and a market for an interlocking three-dimensional puzzle which has a variety of solutions which can provide many hours of puzzle consumer enjoyment.

The above principals are readily apparent from the past puzzles or models utilizing simple construction of disc components to form a puzzle or model solution. For example, Joy U.S. Pat. No. 1,050,141; Wiswesser U.S. Pat. No. 2,446,120; Kenney U.S. Pat. No. 3,577,660; and Burtch U.S. Pat. No. 5,465,961 describe puzzles or models comprising disc components having radial slots interlockable to form a representation of a spherical device. However, due to the simple construction and limited number of puzzle pieces therein, these prior art patents fail to entice the puzzle consumer to disassemble the puzzle and attempt to reconstruct it again and again for hours of puzzle enjoyment.

A further example of interlocking disc puzzles and models include Perry U.S. Pat. No. 2,961,779 describing an educational manipulative device having discs with apertures formed therein and projecting stems extending therefrom for connecting the discs in an overlapping two-dimensional pattern. Unfortunately, only basic two-dimensional patterns are possible which will quickly fail to satisfy any novice or expert puzzle or model maker.

SUMMARY OF THE INVENTION

The present invention is a three-dimensional puzzle having a plurality of puzzle pieces. Each of the puzzle pieces is referred to as a disc, and, in preferred embodiments has a geometric shape which is approximately circular with a center point, a circumferential outer edge, and a radius extending from approximately the center point to the outer edge. However, as used herein, the term a "disc" is not limited to a circular shape, but can be any equivalent regular flat element, such as any even sided isosceles polygon.

Describing the puzzle pieces in greater detail, each includes a first flat side surface, a second flat side surface opposite the first side surface, and an outer circumferential surface between the first side surface and the second side surface around the circumference of each puzzle piece. Each of the puzzle pieces further includes a radial slot extending from approximately the center point along the radius to and through the outer edge and the outer surface.

The slots of the puzzle pieces include a first slot surface, a second slot surface spaced and substantially coplanar to the first slot surface, and an end slot surface between and substantially perpendicular to both the first slot surface and the second slot surface. Additionally, each of the puzzle pieces has a void area formed therein. Calculating the area of the void area is accomplished by first extending a pair of substantially perpendicular tangent lines from each of the outer edges until the tangent lines intersect at an intersection point outside the circumference of the puzzle piece. At the intersection point of the tangent lines, a line is extended through the center point of the puzzle piece and the intersection point. At a predetermined distance from the intersection point along the line, a void area center point is established. An arc having a predetermined radius is constructed from the void area center point intersecting the puzzle piece creating an arc edge. The area between the arc edge and the circumference of the puzzle piece creates the void area of the puzzle pieces. Where the disc is a polygon the void area is angular.

Furthermore, each of the puzzle pieces has a first aperture and a second aperture formed therethrough. In each of the puzzle pieces, either the first aperture or the second aperture, but not both apertures, includes a pin protruding therefrom. The pin is preferably constructed from the same material as the puzzle piece, and preferably has a diameter substantially equal to the diameter of the first aperture or the second aperture, thereby allowing the pin to snugly fit within the first aperture or the second aperture of the puzzle piece. Preferably, the pin has a substantially flat planar first end and a substantially flat planar second end. The pin preferably extends completely through the puzzle piece until the second end is substantially flush with the second side surface and the first end protrudes above the first side surface. Where desired, the pin can be formed integral with the puzzle piece and not inserted in an aperture.

In the preferred embodiment, the first end of the pin includes a beveled edge about the circumference of the first end of the pin and a pin slot extending from the first end of the pin into the pin along the longitudinal length of the pin. The beveled edge and the pin slot of the pin cooperate to assist in inserting the pin into an adjacent first aperture or second aperture.

In the preferred embodiment of the present invention there are four different types of puzzle pieces, namely a first puzzle set, a second puzzle set, a third puzzle set, and a fourth puzzle set. Each of the puzzle pieces in each of the puzzle sets are substantially identical to each of the other puzzle pieces in the same puzzle set with regard to their characteristics of pin position, slot placement, and void area location.

To construct the puzzle of the present invention, first, the first side surfaces of the puzzle pieces of the first puzzle set are positioned against the first side surfaces of the puzzle pieces of the second puzzle set with the slots of the first puzzle set aligning with the slots of the second puzzle set. By constructing the puzzle in the described fashion, the pins of the first puzzle set are received within the void area of the second puzzle set and the pins of the second puzzle set are received within the void area of the first puzzle set.

Second, similar to the construction of the first puzzle set and the second puzzle set, the first side surfaces of the puzzle pieces of the third puzzle set are positioned against the first side surfaces of the puzzle pieces of the fourth puzzle set with the slots of the first puzzle set aligning with the slots of the second puzzle set. By constructing the puzzle in the described fashion, the pins of the third puzzle set are received within the void area of the fourth puzzle set and the pins of the fourth puzzle set are received within the void area of the third puzzle set.

Third, the combined puzzle pieces of the first and second puzzle sets are releasably secured to the combined puzzle pieces of the third and fourth puzzle sets by aligning the slots of the combined puzzle pieces of the first and second puzzle sets with the slots of the combined puzzle pieces of the third and fourth puzzle sets and then inserting the combined puzzle pieces of the third and fourth puzzle sets into the slots of the first and second puzzle sets and inserting the combined puzzle pieces of the first and second puzzle sets into the slots of the third and fourth puzzle sets. The puzzle sets are inserted within the other puzzle sets' slots until the end surfaces of the slots of the first and second puzzle pieces are positioned against the end surfaces of the slots of the third and fourth puzzle pieces.

To complete the puzzle of the present invention, each of the pins of each of the puzzle pieces are inserted into the open first aperture or the open second aperture of a different puzzle piece. The puzzle consumer continues solving and constructing the puzzle pieces until a substantially spherical puzzle is formed.

However, as used herein a "disc" is not limited to a circular shape, but can be any regular flat element, such as any isosceles polygon.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 7:
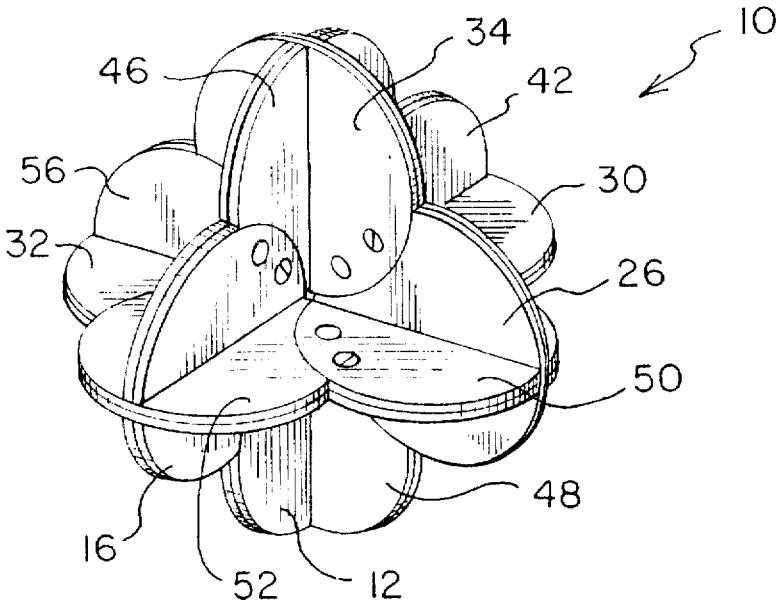
FIG. 7 is a perspective view of the three-dimensional puzzle according to a preferred embodiment of the present invention illustrating the completed puzzle.
Figure 1A:
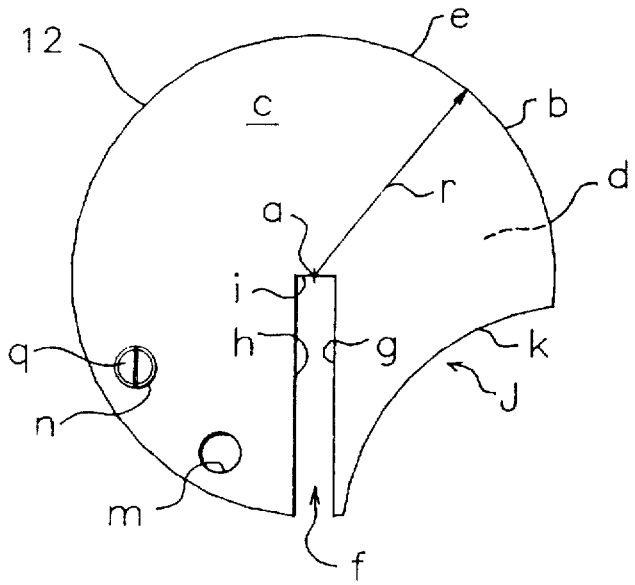
FIG. 1A is an enlarged top view according to a preferred embodiment of the present invention illustrating one representative puzzle piece having a slot, a male element in the form of a pin, and a female element in the form of an aperture.
Figure 1B:
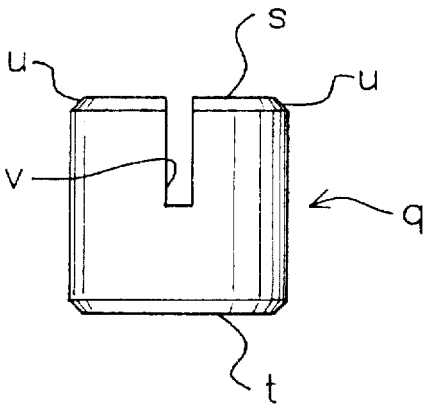
FIG. 1B is a further enlarged side view of a pin of the three-dimensional puzzle according to a preferred embodiment of the present invention illustrating a beveled edge, a first end of the pin, and a slot therein.

As illustrated in FIG. 7, the present invention is a three-dimensional puzzle, indicated generally at 10. In a preferred embodiment of the present invention, the puzzle 10 includes twenty-four puzzle pieces 12, 14, 16, 18, 20, 22, 24, 26, 28, 30, 32, 34, 36, 38, 40, 42, 44, 46, 48, 50, 52, 54, 56, and 58, alternately referred to as pieces 12–58. As noted above, FIG. 1A is an enlarged top view illustrating one representative puzzle piece 12 having a slot 12*f*, a male element in the form of pin 12*q* and a female element in the form of aperture 12*m* or 12*n*. By reference to FIG. 1C it will be seen that twelve pieces having the configuration of FIG. 1A are used in the preferred embodiment of the present invention, as set forth in Set 60 and Set 62, but with pins and holes in a variety of configurations. By reference to FIG. 1C it will also be seen that twelve pieces having a configuration similar to that of FIG. 1A are set forth in Set 64 and Set 66, but with their slots f radially opposed to the slots of Set 60 and 62. As will be explained in greater detail below in the discussion of FIG. 3, this allows the combined pieces to be releasably interconnectably secured together. FIG. 1B is a further enlarged side view of pin q having a beveled edge u, a first end of the pin s, and a slot v. When referring to other puzzle pieces herein below, the same alphabetic suffixes refer to the same elements or parts on those puzzle pieces.

Now referring to FIG. 1C, the present invention will be described as having twenty-four puzzle pieces 12–58, although, as is noted below, a puzzle having puzzle pieces numbering more or less than twenty-four is within the scope and the teaching of the present invention. Each of the preferred puzzle pieces 12–58 have a respective geometric circumference which is substantially circular, each with a respective center point 12*a*, 14*a*, 16*a*, 18*a*, 20*a*, 22*a*, 24*a*, 26*a*, 28*a*, 30*a*, 32*a*, 34*a*, 36*a*, 38*a*, 40*a*, 42*a*, 44*a*, 46*a*, 48*a*, 50*a*, 52*a*, 54*a*, 56*a*, and 58*a*; a respective circumferential outer edge 12*b*, 14*b*, 16*b*, 18*b*, 20*b*, 22*b*, 24*b*, 26*b*, 28*b*, 30*b*, 32*b*, 34*b*, 36*b*, 38*b*, 40*b*, 42*b*, 44*b*, 46*b*, 48*b*, 50*b*, 52*b*, 54*b*, 56*b*, and 58*b*; and a respective radius, 12*r*, 14*r*, 16*r*, 18*r*, 20*r*, 22*r*, 24*r*, 26*r*, 28*r*, 30*r*, 32*r*, 34*r*, 36*r*, 38*r*, 40*r*, 42*r*, 44*r*, 46*r*, 48*r*, 50*r*, 52*r*, 54*r*, 56*r*, and 58*r*, each radius extending from approximately the respective center point 12*a*–58*a* to the respective outer edge 12*b*–58*b*. In one preferred embodiment of the present invention puzzle 10 having twenty four puzzle pieces 12–58 each with a radius 12*r*–58*r* of approximately 1.5 inches has utility for puzzle construction by both adult and child puzzle builders having both large and small hands. However, equivalent puzzles 10 having puzzle pieces 12–58 with a radius 12*r*–58*r* greater or less than approximately 1.5 inches are also within the scope and teaching of the present invention.

Furthermore, each of the puzzle pieces 12–58 includes a first flat side surface 12*c*, 14*c*, 16*c*, 18*c*, 20*c*, 22*c*, 24*c*, 26*c*, 28c, 30c, 32c, 34c, 36c, 38c, 40c, 42c, 44c, 46c, 48c, 50c, 52c, 54c, 56c, and 58c, a second flat side surface 12d, 14d, 16d, 18d, 20d, 22d, 24d, 26d, 28d, 30d, 32d, 34d, 36d, 38d, 40d, 42d, 44d, 46d, 48d, 50d, 52d, 54d, 56d, and 58d (see FIG. 2) opposite the first side surface 12c–58c, and an outer circumferential surface 12e, 14e, 16e, 18e, 20e, 22e, 24e, 26e, 28e, 30e, 32e, 34e, 36e, 38e, 40e, 42e, 44e, 46e, 48e, 50e, 52e, 54e, 56e, and 58e between the first side surface 12c–58c and the second side surface 12e–58e and around the circumference of the puzzle piece 12–58. The outer surface 12e–58e of the puzzle pieces 12–58 preferably has a thickness of approximately 0.125 inch, however, puzzle pieces 12–58 having an outer surface 12e–58e with a thickness greater or less than approximately 0.125 inch are also within the scope and teaching of the present invention.

Figure 2:
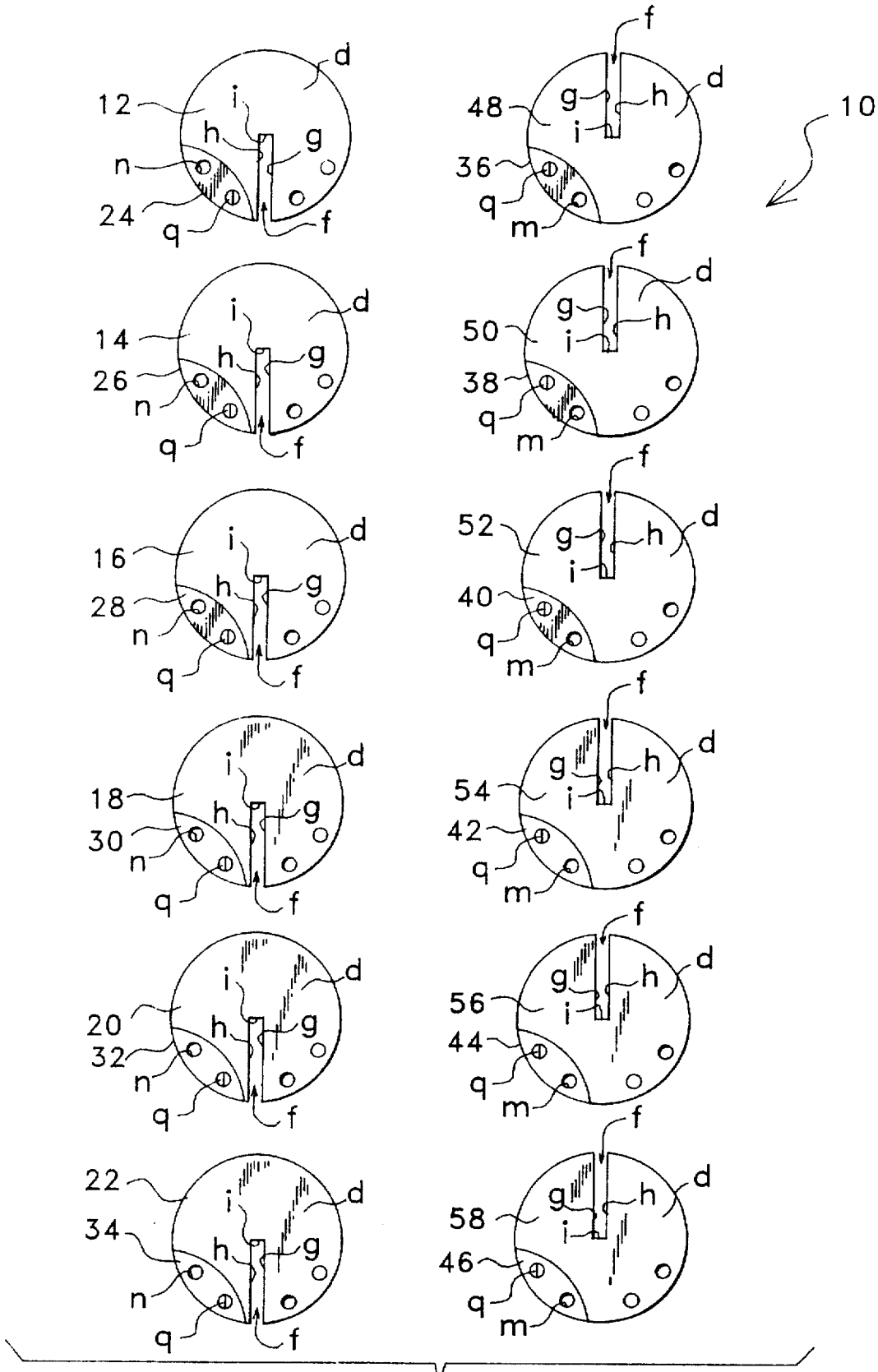
FIG. 2 is a top view of the three-dimensional puzzle according to a preferred embodiment of the present invention illustrating a first step in constructing the puzzle by combining the twenty-four puzzle pieces into twelve combined pairs of puzzle pieces.

As illustrated in FIG. 1A with respect to piece 12, and as further illustrated in FIG. 2 each of the puzzle pieces 12–58 further includes a respective slot 12f, 14f, 16f, 18f, 20f, 22f, 24f, 26f, 28f, 30f, 32f, 34f, 36f, 38f, 40f, 42f, 44f, 46f, 48f, 50f, 52f, 54f, 56f, and 58f extending completely through the puzzle pieces 12–58 including through the first side surface 12c–58c and the second side surface 12d–58d approximately from the center point 12a–58a along the radius 12r–58r to and through the outer edge 12b–58b and the outer surface 12f–58f. Each slot 12f–58f is preferably approximately 0.25 inch in width and preferably approximately 1.5 inches in length, i.e. substantially equal to the width of the radius 12r–58r. It is important to the practice of the present invention that each of the slots 12f–58f have approximately equal lengths to each other slot 12f–58f and have widths greater than approximately double the thickness of the puzzle pieces 12–58. Furthermore, while it is within the scope and teaching of the present invention to have puzzle pieces 12–58 having slots 12f–58f with a width greater than or less than approximately 0.25, a person skilled in the art will recognize, and as is further evident below, that the actual length of each of the slots 12f–58f should be approximately equal in length to the radii 12r–58r to correctly build and form the puzzle 10 of the present invention.

Each of the slots 12f–58f of the puzzle pieces 12–58 include a first slot surface 12g, 14g, 16g, 18g, 20g, 22g, 24g, 26g, 28g, 30g, 32g, 34g, 36g, 38g, 40g, 42g, 44g, 46g, 48g, 50g, 52g, 54g, 56g, and 58g, a second slot surface 12h, 14h, 16h, 18h, 20h, 22h, 24h, 26h, 28h, 30h, 32h, 34h, 36h, 38h, 40h, 42h, 44h, 46h, 48h, 50h, 52h, 54h, 56h, and 58h spaced and substantially coplanar to the first slot surface 12g–58g, and an end slot surface 12i, 14i, 16i, 18i, 20i, 22i, 24i, 26i, 28i, 30i, 32i, 34i, 36i, 38i, 40i, 42i, 44i, 46i, 48i, 50i, 52i, 54i, 56i, and 58i between and substantially perpendicular to the first slot surface 12g–58g and the second slot surface 12h–58h. Operation of the slots 12f–58f, the first slot surfaces 12g–58g, the second slot surfaces 12h–58h, and the end slot surfaces 12i–58i in creating the puzzle 10 will be described in further detail below.

Figure 1C:
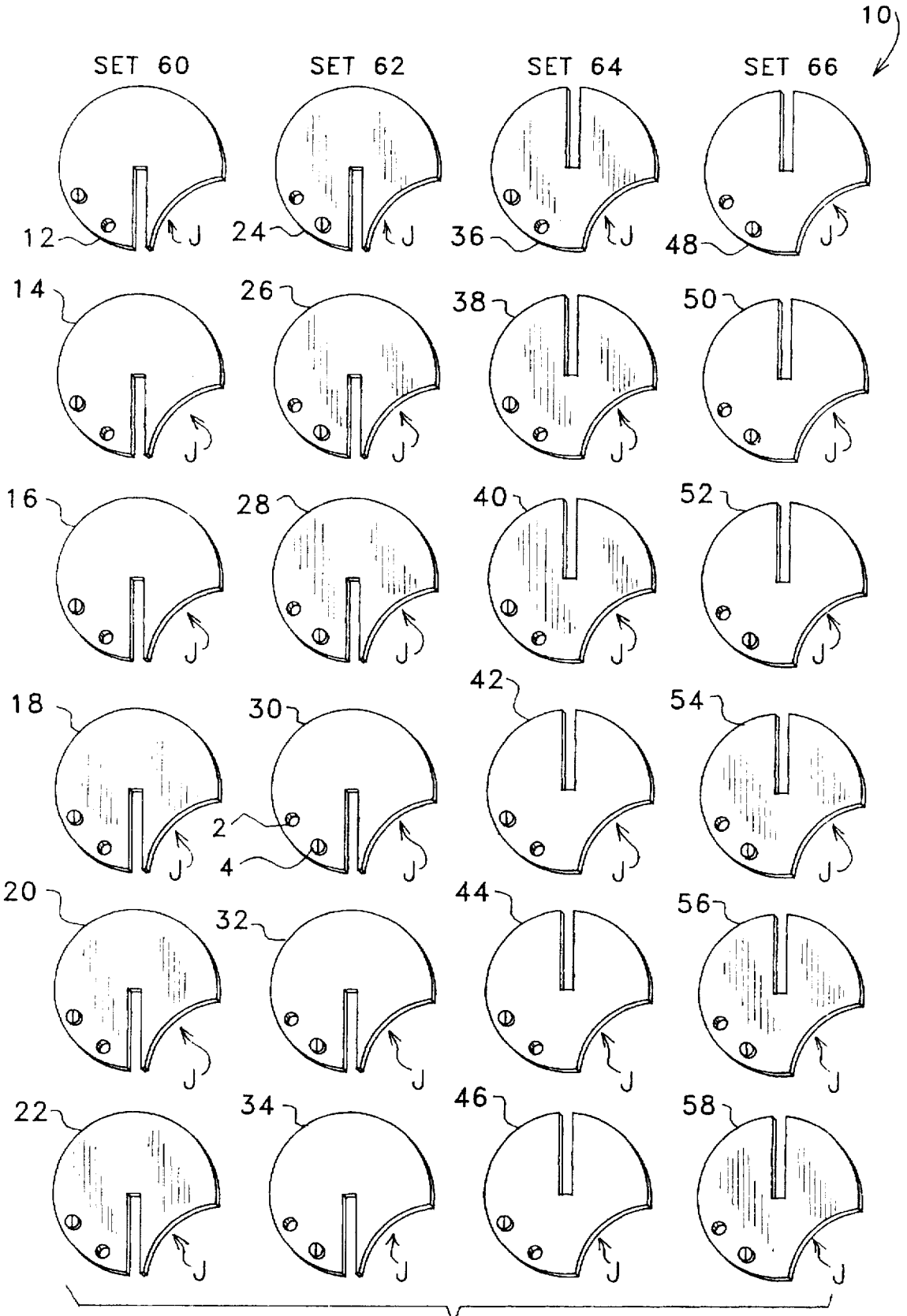
FIG. 1C is a top view of the three-dimensional puzzle according to a preferred embodiment of the present invention illustrating twenty-four solution oriented puzzle pieces, each similar to FIG. 1A, prior to their combination in the construction of the puzzle, each puzzle piece having a slot, a male element, a female element, and a pin.

Additionally, as illustrated in FIG. 1A with respect to piece 12, and as shown in FIG. 1C, each of the puzzle pieces 12–58 have an arcuate void area 12j, 14j, 16j, 18j, 20j, 22j, 24j, 26j, 28j, 30j, 32j, 34j, 36j, 38j, 40j, 42j, 44j, 46j, 48j, 50j, 52j, 54j, 56j, and 58j formed therein. Calculating the area of the void area 12j–58j is accomplished by first extending a pair of substantially perpendicular tangent lines from each of the outer edge 12b–58b until the tangent lines intersect at an intersection point. At the intersection point of the tangent lines, a line is extended through the center point 12a–58b and the intersection point. Where puzzle pieces 12–58 each have a radius 12r–58r of approximately 1.5 inches, than at approximately 0.1875 inch from the intersection point along the line, i.e., approximately 1.6875 inches from the center point 12a–58a, a void area center point is established. An arc having a radius of approximately 1.5 inches is constructed from the void area center point intersecting teach of the puzzle pieces 12–58 creating an arc edge 12k, 14k, 16k, 18k, 20k, 22k, 24k, 26k, 28k, 30k, 32k, 34k, 36k, 38k, 40k, 42k, 44k, 46k, 48k, 50k, 52k, 54k, 56k, and 58k. The puzzle pieces 12–58 between the arc edge 12k–58k and the circumference of the puzzle pieces 12–58 creates the void areas 12j–58j of the puzzle pieces 12–58. While the puzzle 10 has been described as having a rounded arc edge 12k–58k, it is within the scope of the present invention to actually have the void area 12j–58j defined by an edge which is not rounded. Nevertheless, the creation of the void area 12j–58j for each of the puzzle pieces 12–58 is important for the proper construction of the three-dimensional puzzle 10 of the present invention.

Furthermore, in the preferred embodiment shown, each of the puzzle pieces 12–58 has a first aperture 12m, 14m, 16m, 18m, 20m, 22m, 24m, 26m, 28m, 30m, 32m, 34m, 36m, 38m, 40m, 42m, 44m, 46m, 48m, 50m, 52m, 54m, 56m, and 58m and a second aperture 12n, 14n, 16n, 18n, 20n, 22n, 24n, 26n, 28n, 30n, 32n, 34n, 36n, 38n, 40n, 42n, 44n, 46n, 48n, 50n, 52n, 54n, 56n, and 58n adjacent the first aperture 12m–58m and both the first aperture 12m–58m and the second aperture 12n–58n being formed completely through the puzzle pieces 12–58. Preferably, each of the first apertures 12m–58m and each of the second apertures 12n–58n have a diameter of approximately 0.25 inch. It should be noted, however, first apertures 12m–58m and second apertures 12n–58n having diameters greater and less than approximately 0.25 inch are within the scope of the present invention, as are puzzle pieces in which the pin is formed integral with, and not inserted in an aperture.

In each of the puzzle pieces 12–58 shown, either the first aperture 12m–58m or the second aperture 12n–58n has a respective pin 12q, 14q, 16q, 18q, 20q, 22q, 24q, 26q, 28q, 30q, 32q, 34q, 36q, 38q, 40q, 42q, 44q, 46q, 48q, 50q, 52q, 54q, 56q, and 58q protruding therefrom. The pins 12q–58q are preferably constructed from the same material as the puzzle pieces 12–58, although their construction from a different material is within the scope of the present invention. Each pin 12q–58q preferably has a diameter substantially equal to or slightly greater than the diameter of the first aperture 12m–58m and the second aperture 12n–58n allowing the pins 12q–58q to fit snugly within either the first apertures 12m–58m or the second apertures 12m–58m of the puzzle pieces 12–58. Additionally, it is within the scope of the present invention to apply an adhesive substance to the pins 12q–58q to further secure the pins 12q–58q within the respective first apertures 12m–58m or the respective second apertures 12n–58n or to forego the creation of the first apertures 12m–58m or the second apertures 12n–58n and integrally form the pins 12q–58q, i.e., through plastic injection molding, to the puzzle pieces 12–58 during the manufacture of the puzzle pieces 12–58. It is important that each puzzle piece 12–58 has one pin 12q–58q, respectively, and at least one aperture 12m–58m or 12n–58n regardless of whether the pin 12q–58q is inserted into either the first aperture 12m–58m or the second aperture 12n–58n or whether the pin 12q–58q is integrally formed in the puzzle pieces 12–58.

Now, as most clearly shown in FIG. 1B, each pin 12q–58q also has a substantially flat planar first end 12s, 14s, 16s, 18s, 20s, 22s, 24s, 26s, 28s, 30s, 32s, 34s, 36s, 38s, 40s, 42s, 44s, 46s, 48s, 50s, 52s, 54s, 56s, and 58s and a substantially flat planar second end 12t, 14t, 16t, 18t, 20t, 22t, 24t, 26t, 28t, 30t, 32t, 34t, 36t, 38t, 40t, 42t, 44t, 46t, 48t, 50t, 52t, 54t, 56t, and 58t (see FIG. 2). In the preferred embodiment shown, each pin 12q–58q is preferably approximately 0.25 inch in length extending completely through each puzzle piece 12–58 until the flat second end 12t–58t is substantially flush with the second side surface 12d–58d and the first end 12s–58s protrudes approximately 0.125 inch above the first side surface 12c–58c. A person skilled in the art will appreciate that having the first ends 12s–58s of each pin 12q–58q extending approximately 0.125 inch above the first side surface 12c–58c provides each pin 12q–58q the ability to matingly connect with an adjacent first aperture 12m–58m or an adjacent second aperture 12n–58n of an adjacent puzzle piece 12–58 such that the first end 12s–58s is substantially flush with the second side surface 12d–58d of an adjacent puzzle piece 12–58. Furthermore, while the actual length of each pin 12q–58q has been described as being approximately twice the thickness of the puzzle piece 12–58, it is within the scope of the present invention to have a pin 12q–58q which is actually less than or greater than the thickness of each puzzle piece 12–58. It is also possible for puzzle pieces of dimensions other than those which are specifically taught to be produced and used in accordance with the teaching of the present invention.

In the preferred embodiment, the first end of each pin 12q–58q includes a beveled edge 12u, 14u, 16u, 18u, 20u, 22u, 24u, 26u, 28u, 30u, 32u, 34u, 36u, 38u, 40u, 42u, 44u, 46u, 48u, 50u, 52u, 54u, 56u, and 58u about the circumference of the first end 12s–58s of the pins 12q–58q and pin slots 12v, 14v, 16v, 18v, 20v, 22v, 24v, 26v, 28v, 30v, 32v, 34v, 36v, 38v, 40v, 42v, 44v, 46v, 48v, 50v, 52v, 54v, 56v, and 58v extending from the first end 12s–58s of each pin 12q–58q into the pin along the longitudinal length of the pin. Preferably each pin slot 12v–58v is approximately 0.125 inch in length, however, a pin slot 12v–58v having a length greater than or less than 0.125 inch is within the scope of the present invention. The beveled edge 12u–58u and the pin slot 12v–58v of each pin 12q–58q cooperates to assist in inserting the pins 12q–58q into an adjacent first aperture 12m–58m or an adjacent second aperture 12n–58n by allowing the first ends 12s–58s of the pins 12q–58q to deform as the pins 12q–58q is inserted into the first aperture 12m–58m or the second aperture 12n–58n of an adjacent puzzle piece 12–58.

Referring now to FIG. 1C, in the preferred embodiment of the present invention there are four different types of puzzle pieces 12–58, namely a first puzzle set 60 consisting of puzzle pieces 12, 14, 16, 18, 20, and 22, a second puzzle set 62 consisting of puzzle pieces 24, 26, 28, 30, 32, and 34, a third puzzle set 64 consisting of puzzle pieces 36, 38, 40, 42, 44, and 46, and a fourth puzzle set 66 consisting of puzzle pieces 48, 50, 52, 54, 56, and 58. Each of the puzzle pieces 12–58 in each of the respective puzzle sets 60, 62, 64, 66 is substantially identical to each of the other puzzle pieces 12–58 in the same puzzle set 60, 62, 64, 66 in the following areas: pin position, slot placement, and void area location. Each of the puzzle sets 60, 62, 64, 66 will now be described in detail below.

In first puzzle set 60, each of the slots 12f–22f of the puzzle pieces 12–22 of the first puzzle set 60 are preferably positioned directly adjacent the void area 12j–22j of the puzzle pieces 12–22. The first aperture 12m–22m is positioned adjacent the slot 12f–22f opposite the void area 12j–22j with the second aperture 12n–22n radially offset from the first aperture 12m–22m in a direction generally away from the slot 12f–22f. The pins 12q–22q is positioned within or formed at the location of the second aperture 12n–22n while the first aperture 12m–22m remains open.

In second puzzle set 62, the construction of the puzzle pieces 24–34 of the second puzzle set 62 is substantially similar to the construction of the puzzle pieces 12–22 of the first puzzle set 60. The difference between the first puzzle set 60 and the second puzzle set 62 is that each pin 24q–34q of the puzzle pieces 24–34 of the second puzzle set 62 is positioned within or formed at the location of the first aperture 24m–34m while the second aperture 24n–34n of the puzzle pieces 24–34 of the second puzzle set 62 remains open.

In third puzzle set 64, each of the slots 36f–46f of the puzzle pieces 36–46 of the third puzzle set 64 is positioned substantially opposite the void area 36j–46j, the first aperture 36m–46m and the second aperture 36n–46n. Similar to the first puzzle set 60, each pin 36q–46q of the puzzle pieces 36–46 of the third puzzle set 64 is positioned within or formed at the location of the second aperture 36n–46n of the puzzle pieces 36–46 while the first aperture 36m–46m of the puzzle pieces 36–46 remains open.

In fourth puzzle set 66, each of the slots 48f–58f of the puzzle pieces 48–58 of the fourth puzzle set 66 is positioned similar to the slots 36f–46f of the puzzle pieces 36–46 of the third puzzle set 64 in that each of the slots 48f–58f of the puzzle pieces 48–58 of the fourth puzzle set 66 are positioned substantially opposite the void area 48j–48j, the first aperture 48m–58m, and the second aperture 48n–58n. Similar to the second puzzle set 62, each pin 48q–58q of the puzzle pieces 48–58 of the fourth puzzle set 66 is positioned within or formed at the location of the first aperture 48m–58m of the puzzle pieces 48–58 while the second aperture 48n–58n of the puzzle pieces 48–58 remains open.

SOLVING THE PUZZLE

The solution to completing the puzzle 10 will now be described in detail. It should be noted that the following description for the solution of the puzzle 10 is merely one preferred embodiment for solution. One skilled in the art will appreciate that it is within the scope of the present invention to solve the puzzle 10 of the present invention in a variety of different but equivalent ways.

First, as illustrated in FIG. 2, the first side surfaces 12c–22c of the puzzle pieces 12–22 of the first puzzle set 60 are positioned against the first side surfaces 24c–34c of the puzzle pieces 24–34 of the second puzzle set 62 with the slots 12f–22f of the first puzzle set 60 aligning with the slots 24f–34f of the second puzzle set 62. Specifically, the first side surface 12c of the puzzle piece 12 is positioned against the first side surface 24c of the puzzle piece 24 aligning the slot 12f with the slot 24f; the first side surface 14c of the puzzle piece 14 is positioned against the first side surface 26c of the puzzle piece 26 aligning the slot 14f with the slot 26f; the first side surface 16c of the puzzle piece 16 is positioned against the first side surface 28c of the puzzle piece 28 aligning the slot 16f with the slot 28f; the first side surface 18c of the puzzle piece 18 is positioned against the first side surface 30c of the puzzle piece 30 aligning the slot 18f with the slot 30f; the first side surface 20c of the puzzle piece 20 is positioned against the first side surface 32c of the puzzle piece 32 aligning the slot 20f with the slot 32f; and the first side surface 22c of the puzzle piece 22 is positioned against the first side surface 34c of the puzzle piece 34 aligning the slot 22f with the slot 34f.

By constructing the puzzle 10 of the present invention in the described fashion, the pins 12q–22q of the first puzzle set 60 is received within the void area 24j–34j of the second puzzle set 62 and the pins 24q–34q of the second puzzle set 62 is received within the void area 12j–22j of the first puzzle set. The pins 12q–22q extends through the void area 24j–34j to approximately the second side surface 24d–34d of the puzzle pieces 24–34 and the pins $^{2}$4q–34q extends through the void area 12j–22j to approximately the second side surface 12d–22d of the puzzle pieces 12–22.

Second, similar to the construction of the first puzzle set 60 and the second puzzle set 62 described above, the first side surfaces 36c–46c of the puzzle pieces 36–46 of the third puzzle set 64 are positioned against the first side surfaces 48c–58c of the puzzle pieces 48–58 of the fourth puzzle set 66 with the slots 36f–46f of the third puzzle set 64 aligning with the slots 48f–58f of the fourth puzzle set. Specifically, the first side surface 36c of the puzzle piece 36 is positioned against the first side surface 48c of the puzzle piece 48 aligning the slot 36f with the slot 48f; the first side surface 38c of the puzzle piece 38 is positioned against the first side surface 50c of the puzzle piece 50 aligning the slot 38f with the slot 50f; the first side surface 40c of the puzzle piece 40 is positioned against the first side surface 52c of the puzzle piece 52 aligning the slot 40f with the slot 52f; the first side surface 42c of the puzzle piece 42 is positioned against the first side surface 54c of the puzzle piece 54 aligning the slot 42f with the slot 54f; the first side surface 44c of the puzzle piece 44 is positioned against the first side surface 56c of the puzzle piece 56 aligning the slot 44f with the slot 56f; and the first side surface 46c of the puzzle piece 46 is positioned against the first side surface 58c of the puzzle piece 58 aligning the slot 46f with the slot 58f.

By constructing the puzzle 10 of the present invention in the above described fashion, the pins 36q–46q of the third puzzle set 64 is received within the void area 48j–58j of the fourth puzzle set 66 and the pins 48q–58q of the fourth puzzle set 66 is received within the void area 36j–46j of the third puzzle set. The pins 36q–46q extends through the void area 48j–58j to approximately the second side surface 48d–58d of the puzzle pieces 48–58 and the pins 48q–58q extends through the void area 36j–46j to approximately the second side surface 36d–46d of the puzzle pieces 36–46.

Figure 3:
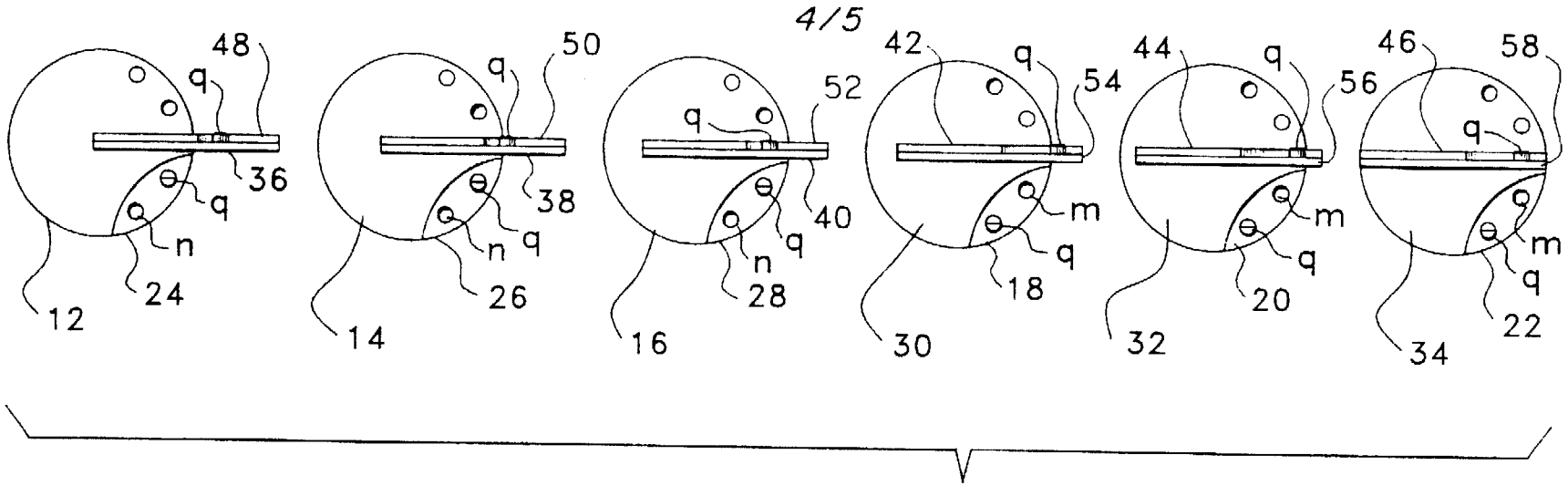
FIG. 3 is a perspective view of the three-dimensional puzzle according to a preferred embodiment of the present invention illustrating a next step in constructing the puzzle by interlocking the slots of the combined puzzle pieces pairs together into an interlocked puzzle group.

Third, as illustrated in FIG. 3, the combined puzzle pieces 12–34 of the first and second puzzle sets 60, 62 are releasably interconnectably secured to the combined puzzle pieces 36–58, respectively, of the third and fourth puzzle sets 64, 66. This is accomplished by aligning the slots 12f–34f as shown in FIG. 2, respectively, with the slots 36f–58f as shown in FIG. 3, respectively, and inserting the combined puzzle pieces 36–58, respectively, into the slots 12f–34f as shown in FIG. 2, respectively, and inserting the combined puzzle pieces 12–34, respectively, into the slots 36f–58f as shown in FIG. 3, respectively. In addition, FIG. 3, illustrates the sequential insertion of combined puzzle pieces 12–34 with the combined puzzle pieces 36–58. That is combined puzzle pieces 12/24 and 36/48 are shown at the initiation of the alignment and insertion process, and combined puzzle pieces 22/34 and 46/58 are shown at the completion of the insertion process, with the other combinations showing the progress of the insertion process. The slots and surfaces referred to but not shown in FIG. 3 are shown in FIG. 2.

Specifically, the combined puzzle pieces 12, 24 are releasably interconnectably secured to the combined puzzle pieces 36, 48 by inserting the combined pieces 36, 48 into the slots 12f, 24f, not shown in FIG. 3, and inserting the combined pieces 12, 24 into the slots 36f, 48f, not shown in FIG. 3, until the end surfaces 12i, 24i, not shown in FIG. 3, of the slots 12f, 24f are positioned against the end surfaces 36i, 48i, not shown in FIG. 3, of the slots 36f, 48f, the first slot surface 12g and the second slot surface 24h, not shown in FIG. 3, are positioned against the second side surface 36d, not shown in FIG. 3, the second slot surface 12h and the first slot surface 24g, not shown in FIG. 3, are positioned against the second side surface 48d, the first slot surface 36g and the second slot surface 48h, not shown in FIG. 3, are positioned against the second side surface 24d, and the second slot surface 36h and the first slot surface 48g, not shown in FIG. 3, are positioned against the second side surface 12d, not shown in FIG. 3.

The combined puzzle pieces 14, 26 are releasably interconnectably secured to the combined puzzle pieces 38, 50 by inserting the combined pieces 38, 50 into the slots 14f, 26f, not shown in FIG. 3, and inserting the combined pieces 14, 26 into the slots 38f, 50f, not shown in FIG. 3, until the end surfaces 14i, 26i of the slots 14f, 26f, not shown in FIG. 3, are positioned against the end surfaces 38i, 50i of the slots 38f, 50f, not shown in FIG. 3, the first slot surface 14g and the second slot surface 26h, not shown in FIG. 3, are positioned against the second side surface 38d, the second slot surface 14h and the first slot surface 26g are positioned against the second side surface 50d, the first slot surface 38g and the second slot surface 50h are positioned against the second side surface 26d, and the second slot surface 38h and the first slot surface 50g, all not shown in FIG. 3, are positioned against the second side surface 14d.

The combined puzzle pieces 16, 28 are releasably interconnectably secured to the combined puzzle pieces 40, 52 by inserting the combined pieces 40, 52 into the slots 16f, 28f and inserting the combined pieces 16, 28 into the slots 40f, 52f, not shown in FIG. 3, until the end surfaces 16i, 28i of the slots 16f, 28f are positioned against the end surfaces 40i, 52i of the slots 40f, 52f, all not shown in FIG. 3, the first slot surface 16g and the second slot surface 28h, not shown in FIG. 3, are positioned against the second side surface 40d, the second slot surface 16h and the first slot surface 28g are positioned against the second side surface 52d, the first slot surface 40g and the second slot surface 52h are positioned against the second side surface 28d, and the second slot surface 40h and the first slot surface 52g are positioned against the second side surface 16d, all not shown in FIG. 3.

The combined puzzle pieces 18, 30 are releasably interconnectably secured to the combined puzzle pieces 42, 54 by inserting the combined pieces 42, 54 into the slots 18f, 30f, not shown in FIG. 3, and inserting the combined pieces 18, 30 into the slots 42f, 54f until the end surfaces 18i, 30i, not shown in FIG. 3, of the slots 18, 30 are positioned against the end surfaces 42i, 54i of the slots 42f, 54f, the first slot surface 18g and the second slot surface 30h are positioned against the second side surface 42d, the second slot surface 18h and the first slot surface 30g are positioned against the second side surface 54d, the first slot surface 42g and the second slot surface 54h are positioned against the second side surface 30d, and the second slot surface 42h and the first slot surface 54g are positioned against the second side surface 18d, all not shown in FIG. 3.

The combined puzzle pieces 20, 32 are releasably interconnectably secured to the combined puzzle pieces 44, 56 by inserting the combined pieces 44, 56 into the slots 20f, 32f, not shown in FIG. 3, and inserting the combined pieces 20, 32 into the slots 44f, 56f until the end surfaces 20i, 32i of the slots 20f, 32f are positioned against the end surfaces 44i, 56i of the slots 44f, 56f, the first slot surface 20g and the second slot surface 32h are positioned against the second side surface 44d, the second slot surface 20h and the first slot surface 32g are positioned against the second side surface 56d, the first slot surface 44g and the second slot surface 56h are positioned against the second side surface 32d, and the second slot surface 44h and the first slot surface 56g are positioned against the second side surface 20d, all not shown in FIG. 3.

The combined puzzle pieces 22, 34 are releasably interconnectably secured to the combined puzzle pieces 46, 58 by inserting the combined pieces 46, 58 into the slots 22*f*, 34*f*, not shown in FIG. 3, and inserting the combined pieces 22, 34 into the slots 46*f*, 58*f* until the end surfaces 22*i*, 34*i* of the slots 22*f*, 34*f* are positioned against the end surfaces 46*i*, 58*i* of the slots 46*f*, 58*f*, the first slot surface 22*g* and the second slot surface 34*h* are positioned against the second side surface 46*d*, the second slot surface 22*h* and the first slot surface 34*g* are positioned against the second side surface 58*d*, the first slot surface 46*g* and the second slot surface 58*h* are positioned against the second side surface 34*d*, and the second slot surface 46*h* and the first slot surface 58*g* are positioned against the second side surface 22*d*, all not shown in FIG. 3.

To complete the puzzle 10 of the present invention, the pins 12*q*–58*q* of the puzzle pieces 12–58 are inserted into the open first aperture 12*m*–58*m* or the open second aperture 12*n*–58*n*. A person skilled in the art will appreciate the many variations which the puzzle 10 can be completed from this point forward. One method for completing the puzzle 10 of the present invention will now be described.

Figure 4:
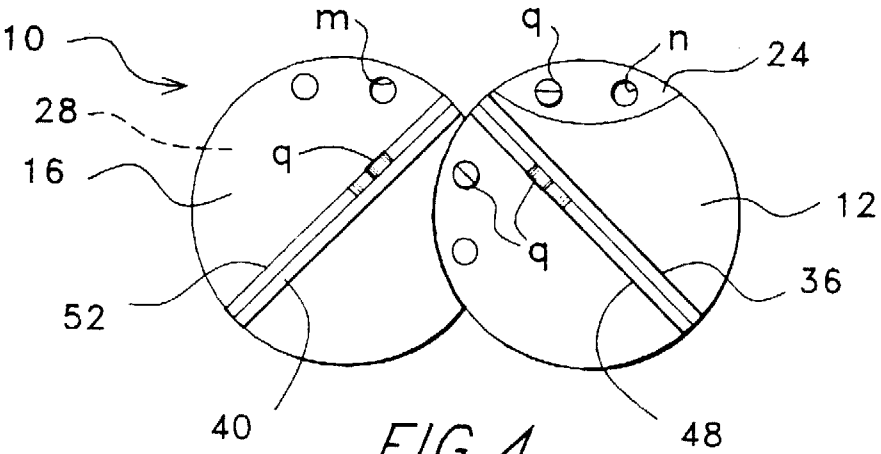
FIG. 4 is a perspective view of the three-dimensional puzzle according to a preferred embodiment of the present invention illustrating a further step in constructing the puzzle by connecting the male element and the female element of the interlocked puzzle groups.

To complete the puzzle 10, first, as illustrated in FIG. 4, the pin 12*q* of the puzzle piece 12 is inserted into the second aperture 28*n* of the puzzle piece 28 while the pin 28*q* is inserted into the first aperture 12*m* thereby aligning the second side surface 12*d* in planar relation to the second side surface 16*d* of the puzzle piece 16 and aligning the second side surface 24*d* of the puzzle piece 24 in planar relation to the second side surface 28*d*.

Figure 5:
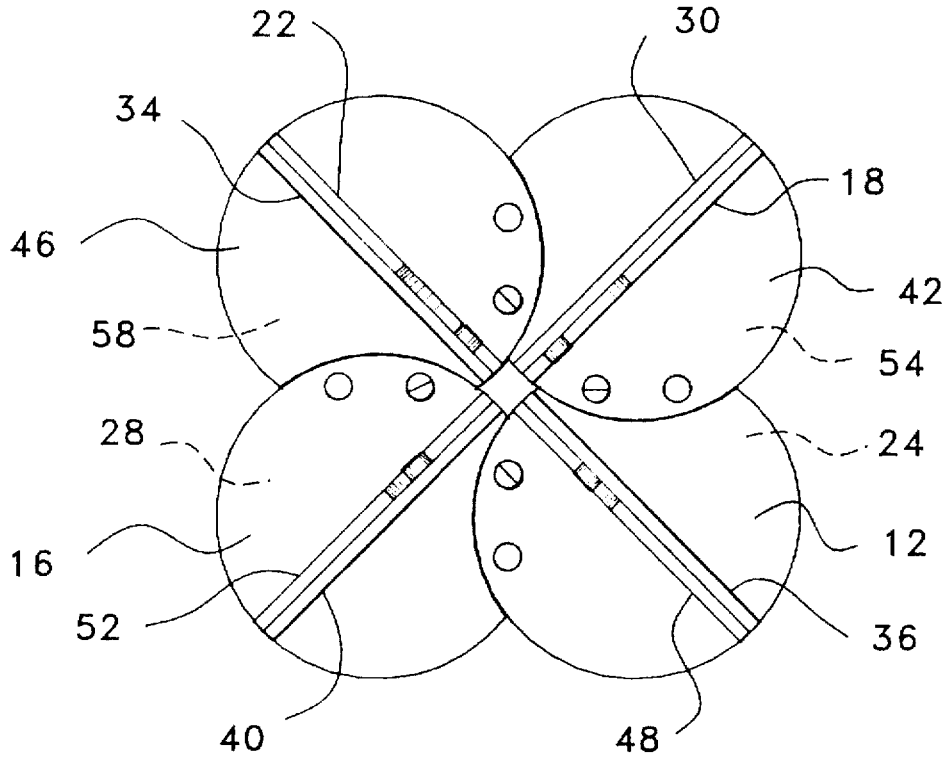
FIG. 5 is a perspective view of the three-dimensional puzzle according to a preferred embodiment of the present invention illustrating another step in constructing the puzzle.

Next, as illustrated in FIG. 5, the pin 16*q* of the puzzle piece 16 is inserted into the second aperture 58*n* of the puzzle piece 58 while the pin 58*q* is inserted into the first aperture 16*m* thereby aligning the second side surface 46*d* of the puzzle piece 46 in planar relation to the second side surfaces 12*d*, 16*d* and aligning the second side surface 58*d* in planar relation to the second side surfaces 24*d*, 28*d*. Then, the pin 46*q* of the puzzle piece 46 is inserted into the second aperture 54*n* of the puzzle piece 54, the pin 54*q* is inserted into the first aperture 46*m*, the pin 42*q* of the puzzle piece 42 is inserted into the second aperture 24*n* of the puzzle piece 24, and the pin 24*q* is inserted into the first aperture 42*m* thereby aligning the second surface 42*d* in planar relation to the second side surfaces 12*d*, 16*d*, 46*d* and aligning the second side surface 54*d* in planar relation to the second side surfaces 24*d*, 28*d*, 58*d*.

Figure 6:
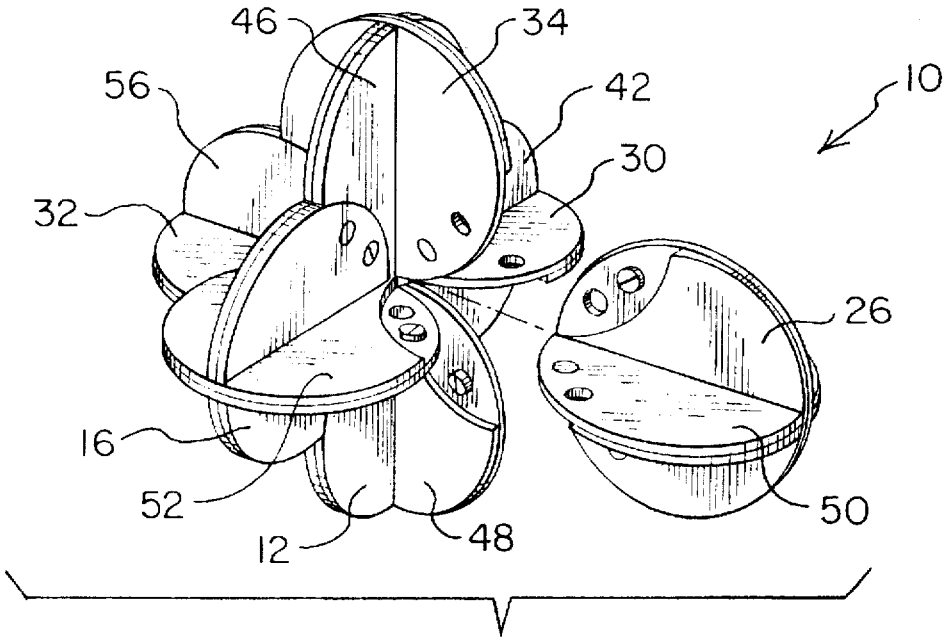
FIG. 6 is a perspective view of the three-dimensional puzzle according to a preferred embodiment of the present invention illustrating still a further step in constructing the puzzle.

Nearing completion of the puzzle 10 of the present invention, as illustrated in FIG. 6, the pin 44*q* of the puzzle piece 44 is inserted into the second aperture 48*n* of the puzzle piece 48 and the pin 48*q* is inserted into the first aperture 44*m*; the pin 44*q* of the puzzle piece 44 is inserted into the second aperture 52*n* of the puzzle piece 52 and the pin 52*q* is inserted into the first aperture 44*m* of the puzzle piece 44; the pin 32*q* of the puzzle piece 32 is inserted into the first aperture 18*m* of the puzzle piece 18 and the pin 18*q* is inserted into the second aperture 32*n* of the puzzle piece 32; and the pin 56*q* of the puzzle piece 56 is inserted into the first aperture 22*m* of the puzzle piece 22 and the pin 22*q* is inserted into the second aperture 56*n*. By constructing the puzzle 10 as described above, the second side surface 20*d* aligns in planar relation to the second side surfaces 18*d*, 30*d*, the second side surface 44*d* aligns in planar relation to the second side surfaces 22*d*, 36*d*, the second side surface 32*d* aligns in planar relation to the second side surfaces 30*d*, 52*d*, and the second side surface 56*d* aligns in planar relation to the second side surfaces 34*d*, 48*d*.

Finally, as illustrated in FIGS. 6 and 7, to complete the puzzle 10 of the present invention, the pin 11*q* of the puzzle piece 14 is inserted into the second aperture 34*n* of the puzzle piece 34 and the pin 34*q* is inserted in the first aperture 14*m*, the pin 36*q* of the puzzle piece 36 is inserted into the second aperture 26*n* of the puzzle piece 26 and the pin 26*q* is inserted into the first aperture 36*m*, the pin 40*q* of the puzzle piece 30 is inserted into the first aperture 38*m* of the puzzle piece 38 and the pin 38*q* is inserted into the second aperture 30*n*, and the pin 50*q* of the puzzle piece 50 is inserted into the first aperture 40*m* of the puzzle piece 40 and the pin 40*q* is inserted in the second aperture 50*n*. By constructing the puzzle 10 as immediately described above, the second side surface 50*d* aligns in planar relation to the second side surfaces 30*d*, 32*d*, 52*d*, the second side surface 14*d* aligns in planar relation to the second side surfaces 22*d*, 44*d*, 36*d*, the second side surface 38*d* aligns in planar relation to the second side surfaces 18*d*, 20*d*, 40*d*, and the second side surface 26*d* aligns in planar relation to the second side surfaces 38*d*, 48*d*, 56*d*, as illustrated in FIG. 7.

The puzzle 10 of the present invention can be constructed from a wide variety of combinations of the puzzle pieces 12–58. The embodiment as described above is simply one possible construction of the puzzle 10 of the present invention. The puzzle pieces 12–58 are connectable in many different combinations so long as the pins 12*q*–58*q* and apertures 12*m*–58*m* or 12*n*–58*n* are positioned within the void areas 12*j*–58*j* and each pin 12*q*–58*q* is received by an aperture 12*m*–58*m* or 12*n*–58*n*.

Furthermore, it is within the scope of the present invention to have the puzzle pieces 12–58 be one color or to have a variety of colors. Having a variety of colors allows the puzzle consumer to change the design of the constructed puzzle 10 depending on the sequence of puzzle pieces 12–58 used by the puzzle consumer in solving and constructing the puzzle 10 of the present invention.

It is also within the scope of the present invention to have only six or twelve puzzle pieces which have the same shape and appearance as the combined puzzle pieces discussed above. Construction of such a puzzle would be similar, except that the step of combining the puzzle pieces 12–58 would be eliminated since the six or twelve puzzle pieces would have a pair of pins and a pair of apertures similar to the combined pieces as illustrated in FIG. 2. The puzzle 10 of the present invention is preferably constructed from a durable rigid plastic material. It should be noted, however, that while the puzzle 10 has been and will be described as being constructed from a plastic material, it is within the scope of the present invention to construct the puzzle 10 from other durable rigid materials including, but not limited to, wood, metal, ceramic, glass, and the like.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

The inventions in which an exclusive right and privilege is claimed are:

1. A three-dimensional take-apart and put-together puzzle comprising:

a plurality of interlockable discs, each disc having a first planar side surface and a second planar side surface substantially parallel and opposed to said first planar side surface;

a male element projecting from each first planar side surface of each disc;

a female element adjacent said male element and extending through said disc, said female element defining a receptacle in each disc for receiving said male element of a different disc;

a radial slot formed in each disc, each radial slot alignable with said radial slot of a corresponding disc upon positioning said first planar surface of one disc upon said first planar surface of the corresponding disc forming an overlapping, unconnected disc set; and whereby the aligned radial slots of an unconnected disc set mateably connect with the aligned radial slots of a corresponding disc set creating interlocking disc groups, each interlocking disc group releasably connecting with at least one other interlocking disc group by mating the male elements with the female elements thereby forming the puzzle.

2. The puzzle as claimed in claim 1 wherein each unconnected disc set creates a first recessed planar area and a second recessed planar area, a male and female element being positioned within each of said first and second recessed planar areas.

3. The puzzle as claimed in claim 2 wherein said male element of each disc in said unconnected disc set extends to approximately the second planar side surface of the corresponding disc of the unconnected disc set.

4. The puzzle as claimed in claim 2 wherein the connection of said male and female elements of an unconnected disc set of a first interlocking disc group to said male and female elements of another unconnected disc set of a second interlocking disc group aligns the second planar side surfaces of the unconnected disc set of the first interlocking disc group to the second planar side surfaces of the unconnected disc set of the second interlocking disc group in coplanar relation.

5. The puzzle as claimed in claim 1 wherein each of the unconnected disc sets have a geometric shape which is substantially circular.

6. The puzzle as claimed in claim 5 wherein the radius of the disc sets is approximately 1.5 inches.

7. The puzzle as claimed in claim 1 wherein the disc has a thickness of approximately 0.125 inch and the slot has a width of approximately 0.25 inch.

8. The puzzle as claimed in claim 1 wherein said male element has a length of approximately 0.125 inch.

9. The puzzle as claimed in claim 1 wherein the discs are constructed from a material selected from the group consisting of plastic, wood, metal, ceramic and glass.

10. The puzzle as claimed in claim 1 wherein the discs have a variety of colors.

11. A three-dimensional take-apart and put-together puzzle comprising:

a plurality of interlocking discs, each disc having a first planar side surface and a second planar side surface substantially parallel to said first planar side surface;

a first recessed planar surface formed in said first planar surface of each disc, each first recessed planar surface being parallel and spaced between said corresponding first and second planar side surfaces;

a second recessed planar surface formed in said second planar surface of each disc, said second recessed planar surface coplanar to said first recessed planar surface, each second recessed planar surface being parallel and spaced between said corresponding first and second planar side surfaces;

a radial slot formed in each disc, each radial slot mateable with said radial slot of a corresponding radial slot of another disc to interlock pairs of discs together creating interlocking disc groups;

a first male element projecting from said first recessed planar surface of each disc, said first male element projecting toward said first planar side surface of said disc;

a second male element projecting from said second recessed planar surface of each disc, said second male element projecting toward said second side surface of said disc;

a first female element adjacent said first male element and extending through said first recessed planar surface and said second planar side surface, said first female element defining a first receptacle in said first recessed planar surface of each disc for receiving a male element of a different disc;

a second female element adjacent said second male element and extending through said second recessed planar surface and said first planar side surface, said second female element defining a second receptacle in said second recessed planar surface of said disc for receiving a male element of a different disc;

whereby said first and second male elements of each of said interlocking disc group releasably connect with said first and second female elements of at least one other interlocking disc pair thereby forming the puzzle.

12. The puzzle as claimed in claim 11 wherein said first male element extends to approximately said second planar side surface.

13. The puzzle as claimed in claim 11 wherein said second element extends to approximately said first planar side surface.

14. The puzzle as claimed in claim 11 wherein the connection of said male and female elements of a first disc of a first interlocking disc group to said male and female elements of second disc of a second interlocking disc group aligns said first and second planar side surfaces of said first disc of said first interlocking disc group to said first and second planar side surfaces, respectively, of said second disc of said second interlocking disc group in coplanar relation, and wherein further each of the discs have a geometric shape which is substantially circular.

15. A method of constructing a three-dimensional take-apart and put-together puzzle, the method comprising:

providing a plurality of discs, each disc having a first planar side surface and a second planar side surface substantially parallel to the first planar side surface;

forming a male element projecting from each first planar side surface of each disc;

forming a female element adjacent the male element and extending through the disc, the female element defining a receptacle in each disc for receiving the male element of a different disc;

forming a radial slot in each disc;

positioning the first planar side surfaces of a pair of discs against one another and aligning the radial slots of each disc creating an overlapping, unconnected disc set; and mateably connecting the aligned radial slots of an unconnected disc set with the aligned radial slots of another unconnected disc set creating interlocking disc groups; and releasably connecting each interlocking disc group with at least one other interlocking disc group by mating the male elements with the female elements.

16. The method as claimed in claim 15 and further comprising forming a first recessed planar area and a second recessed planar area with a male and female element being positioned within each of the first and second recessed planar areas.

17. The method as claimed in claim 16 and further comprising extending the male element of each disc in the unconnected disc set to approximately the second planar side surface of the corresponding disc of the unconnected disc set.

18. The method as claimed in claim 16 and further comprising aligning the second planar side surfaces of the unconnected disc set of a first interlocking disc group to the second planar side surfaces of the unconnected disc set of a second interlocking disc group in coplanar relation.

* * * * *